US005462079A

United States Patent [19]

Loschelder et al.

[11] Patent Number: 5,462,079

[45] Date of Patent: Oct. 31, 1995

[54] ANTI-SIPHON MIXING VALVE

[75] Inventors: Todd C. Loschelder, Macedonia; Erwin F. Mikol, Westlake, both of Ohio

[73] Assignee: Moen Incorporated, North Olmsted, Ohio

[21] Appl. No.: 349,552

[22] Filed: Dec. 5, 1994

[51] Int. Cl.$^6$ ..... F16K 24/02; F16K 11/078

[52] U.S. Cl. ..... 137/216; 137/625.17; 137/889; 137/892

[58] Field of Search ..... 137/216, 625.17, 137/889, 892

[56] References Cited

U.S. PATENT DOCUMENTS

| | | | |
|---|---|---|---|
| 3,056,418 | 10/1962 | Adams et al. . | |
| 3,103,231 | 9/1963 | Moen | 137/625.17 X |
| 3,204,656 | 9/1965 | Moen | 137/625.17 X |
| 3,285,278 | 11/1966 | Corlett | 137/625.17 X |
| 3,893,481 | 7/1975 | Watts | 137/625.17 |
| 4,589,438 | 5/1986 | Breda . | |
| 4,805,661 | 2/1989 | Knapp et al. . | |
| 4,874,006 | 10/1989 | Iqbal . | |
| 4,951,702 | 8/1990 | Brotcke . | |
| 4,969,483 | 11/1990 | Knapp . | |
| 5,095,554 | 3/1992 | Gloor . | |
| 5,123,437 | 6/1992 | Egli et al. . | |
| 5,329,957 | 7/1994 | Semchuck et al. . | |

*Primary Examiner*—Gerald A. Michalsky

*Attorney, Agent, or Firm*—Dorn, McEachran, Jambor & Keating

[57] ABSTRACT

A hot and cold water mixing valve for use with faucets, shower/tub controls and other plumbing fittings includes a sleeve having a hot water inlet and a cold water inlet spaced therefrom and an outlet axially spaced from the inlets. There is a stem movable within the sleeve to control water flow from the inlets to the outlet. There is a water passage between the exterior of the stem and the interior of the sleeve and there is an axially extending air passage within the stem having an outer end in communication with air at ambient pressure. There are air outlets in the stem intermediate its ends which connect the air passage with the exterior of the stem. The stem exterior and the sleeve interior cooperate to provide an anti-siphon device to draw air from the air outlets into the water passage.

8 Claims, 1 Drawing Sheet

ANTI-SIPHON MIXING VALVE

THE FIELD OF THE INVENTION

The present invention relates to faucet and shower/tub control mixing valves and particularly to such a mixing valve including anti-siphon elements. Mixing valves of the type disclosed herein are generally shown in U.S. Pat. Nos. 3,840,048, 3,916,950 and 4,330,011, all owned by Moen Incorporated, assignee of the present application. The present invention provides a configuration on the exterior of the stem which cooperates with radially extending air passages in the stem to draw air from the atmosphere into the mixing valve water passage to prevent back siphonage by breaking the vacuum effect caused by the loss in water pressure.

SUMMARY OF THE INVENTION

The present invention relates to a mixing valve for use in faucets and shower/tub controls and particularly to anti-siphon means for such a mixing valve.

A primary purpose of the invention is an anti-siphon device for a mixing valve which requires no moving parts.

Another purpose is a mixing valve of the type described having elements defining a venturi which is used to create an area of reduced pressure to draw air from the atmosphere into the water passage within the mixing valve.

Another purpose is an anti-siphon device as described which provides for pre-aeration of the water passing through the mixing valve prior to the water reaching the faucet aerator.

Another purpose is a mixing valve as described in which the anti-siphon device will control the volume of water flow through the valve to provide specific maximum flows at required inlet pressures.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
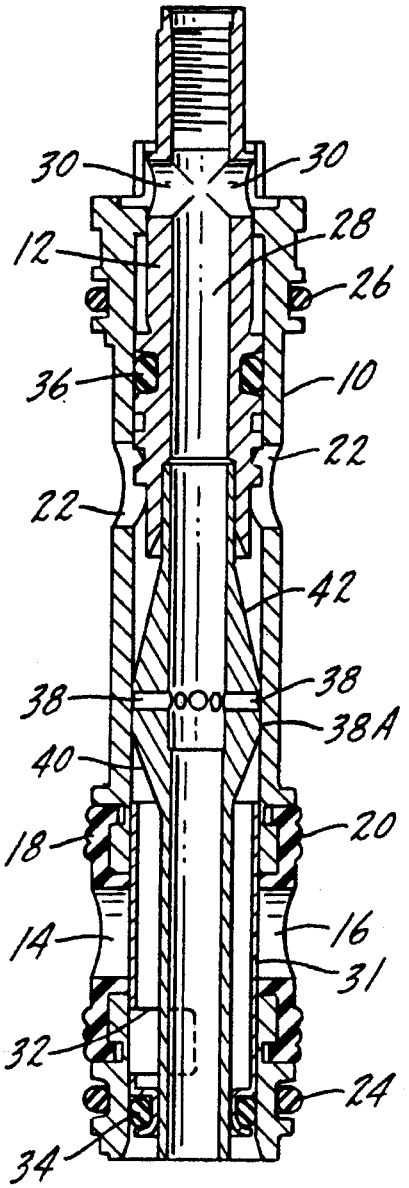
FIG. 1 is an axial section through a mixing valve of the type described.
Figure 2:
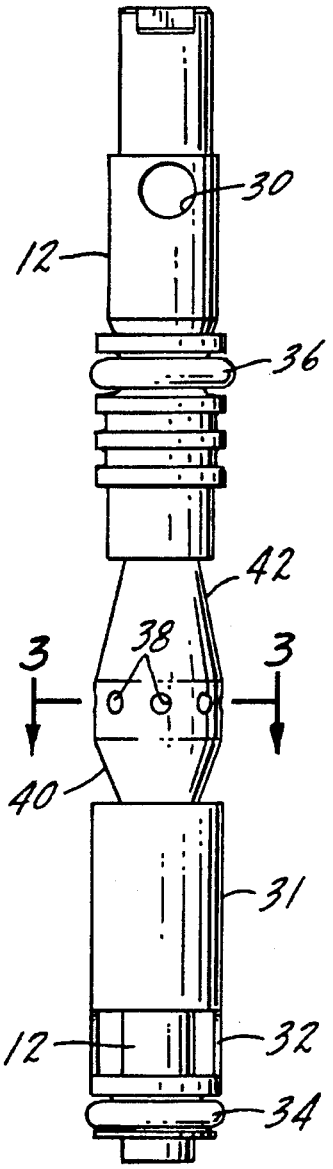
FIG. 2 is a side view of the mixing valve of FIG. 1.
Figure 3:
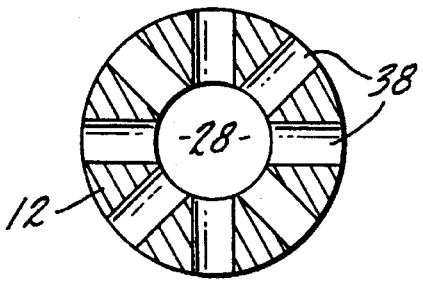
FIG. 3 is a section along plane 3—3 of FIG. 2.

The present invention relates to mixing valves of the type used in kitchen and lavatory faucets and shower/tub controls to regulate the volume and temperature of water supplied at the discharge of the plumbing fitting. U.S. Pat. Nos. 3,840,048, 3,916,950 and 4,330,011 among others, all owned by Moen Incorporated, the assignee of the present invention, illustrate the basic mixing valve. The present invention is specifically concerned with an anti-siphon function for such a mixing valve which requires no moving parts and which incorporates a venturi as a method of introducing air to both break a vacuum within the mixing valve, if such should occur, and to introduce air into the stream of water flowing through the valve. The valve as shown in FIGS. 1, 2 and 3 will be mounted within a housing, either a faucet housing or the body of a shower/tub control or other plumbing fixture.

In the drawings, the mixing valve sleeve is indicated at 10 and the stem is indicated at 12. The sleeve 10 includes a hot water inlet port 14 and a cold water inlet port 16, each of which are surrounded by seal elements indicated at 18 and 20, with the seal elements being disclosed in substantially greater detail in the aforementioned patents. The seal elements are effective to create both a static seal and a dynamic seal between the stem, the sleeve, and the housing surrounding the mixing valve. The static seal prevents leakage of water between the housing and the sleeve and the dynamic seal prevents leakage through the valve when it is closed.

The sleeve 10, in addition to having the described seal elements 18 and 20, has a plurality of water discharge ports 22 which will be in communication with the outlets within the faucet body or the shower/tub control body to direct water to the discharge of the plumbing fitting. The exterior of the sleeve has an O-ring seal 24 at its interior end which will be in sealing engagement with the plumbing fitting housing and has a similar O-ring seal 26 adjacent its outward end, again with the seal ring being in sealing contact with the interior of the housing of the plumbing fitting.

The stem 12 has an axially extending air passage 28 which is open to the atmosphere or to ambient pressure through a series of air inlets 30 adjacent the outward end of the stem. The air passage 28 extends generally the entire axial extent of the stem. Adjacent the inner end of the stem is a piston 31 attached to the stem and having a water inlet 32 which is in the shape of a notch and which may be moved by reciprocation and rotation of the stem 12 into alignment with the water inlets 14 and 16. In such instance when the valve is so opened, water will pass from the inlets into the area outside of the stem and to the water discharge ports as described. The stem is pressure balanced, as more fully described in the above-mentioned patents, and includes an O-ring 34 adjacent its inner end which provides a seal preventing leakage of water to the lower or inward end of the valve cartridge. Similarly, there is an O-ring 36 adjacent the outward end of the stem, again preventing the leakage of water outwardly from the valve cartridge.

Intermediate the inlets 14 and 16 and the outlets 22, the stem has a plurality of radially extending air passages 38, illustrated in detail in FIG. 3, which connect the central air passage 28 with the water passage between the outside of the stem and inside of the sleeve 10. Directly adjacent the air passages 38 the stem has a tapered contour. That portion of the stem adjacent the air passages 38, but on the inward side thereof, has a tapered area 40 and that portion of the stem adjacent the passages 38 which is on the outward side thereof has a tapered area 42, with the taper of the area 42 being slightly less than the taper of the area 40. There is a diametral clearance between the exterior of the stem in the area adjacent the passages 38 and the interior of the sleeve 10, which diametral clearance 38A defines the smallest area of water passage which connects the inlets and the outlets of the valve cartridge. The tapered area 42 accelerates the water flow due to a decrease in flow area and attains its maximum velocity at said diametral clearance 38A. Thus, directly upstream of the passages 38 there is an area of reduced pressure caused by the increase in velocity which will have the effect of drawing air from the passages 38 into the water stream flowing from the inlets to the outlet. This provides pre-aeration of the water flowing through the plumbing fitting.

More importantly, the air passages 38 provide the means for preventing back siphonage. In the unlikely event of a loss in water pressure at the inlet side of the valve and if the exit or discharge of the plumbing fitting is submerged in contaminated water, for example in a sink or bathtub, there can be back siphonage of the contaminated water through the valve into the potable water supply feeding it. However, such back siphonage is prevented by the exposure of the area within the valve cartridge to air at atmospheric or ambient pressure as such air is available through the inlets 30, the passage 28, and the air outlets 38.

This particular structure provides an anti-siphon means, but one which requires no moving parts. Anti-siphon devices are known in the trade, but all usually require movable components and/or check valves to allow air to enter into the system and to seal water from passing outside of the faucet. The use of a venturi permits the air passages to be constantly open as the drop in air pressure at the diametral clerance 38A will prevent water from flowing into the passages 38, thus effectively sealing the passages from the entrance of water. At the same time, the passages 38 provide a means for air to enter into the water system to break any vacuum or reduced pressure within the valve cartridge due to the conditions described above.

The present invention provides an anti-siphon function and it does so with no moving parts. The venturi, as described, provides an area of lowered pressure within the cartridge which effectively seals the passages 38 from water flow. Moreover, during normal operation the passages 38 will provide pre-aeration of the water to be discharged and will provide a control on the volume of water flowing through the valve, which flow control is customarily provided by an aerator. Thus, the use of the described area of reduced water flow provides a number of functions and can reduce the dependence upon an aerator for both flow control and aeration.

Whereas the preferred form of the invention has been shown and described herein, it should be realized that there may be many modifications, substitutions and alterations thereto.

The embodiments of the invention in which an exclusive property or privilege is claimed are defined as follows:

1. A hot and cold water mixing valve including a sleeve having a hot water inlet and a cold water inlet spaced therefrom, discharge opening means in said sleeve axially spaced from said inlets, a stem movable within said sleeve to control water flow from said inlets to said discharge means, water passage means between the exterior of said stem and the interior of said sleeve connecting said inlets and said discharge means, an axially extending air passage within said stem and having an outer end thereof in communication with air at ambient pressure, air outlets in said stem intermediate the ends thereof and connecting said air passage with the exterior of said stem, and cooperating means on the interior of said sleeve and the exterior of said stem limiting the area of said water passage means adjacent said air outlets to provide a venturi to draw air from said air outlets into said water passage means.

2. The mixing valve of claim 1 characterized in that said cooperating means include an area of increased cross section on the exterior of said stem adjacent said air outlets.

3. The mixing valve of claim 2 characterized in that said area of increased cross section gradually increases from the inlet end of said stem toward said air outlets and gradually decreases from said air outlets toward the outlet end of said stem.

4. The mixing valve of claim 3 characterized in that the area of greatest cross sectional area of said stem is coextensive with said stem air outlets.

5. The mixing valve of claim 1 characterized in that said air outlets extend radially from said stem air passage to the exterior of said stem.

6. The mixing valve of claim 1 characterized in that said air passage extends axially within said stem from the inner end thereof toward the outer end, and air inlets adjacent the outer end of said stem connecting said air passage to ambient pressure.

7. A hot and cold water mixing valve including a sleeve having a hot water inlet and a cold water inlet spaced therefrom, discharge opening means in said sleeve axially spaced from said inlets, a stem movable within said sleeve to control water flow from said inlets to said discharge means, water passage means between the exterior of said stem and the interior of said sleeve connecting said inlets and said discharge means, an axially extending air passage within said stem and having an outer end thereof in communication with air at ambient pressure, air outlets in said stem intermediate the ends thereof and connecting said air passage with the exterior of said stem, anti-siphon means on said stem exterior and sleeve interior to draw air from said air outlets into said water passage means.

8. The hot and cold water mixing valve of claim 7 characterized in that said anti-siphon means include means narrowing said water passage means adjacent said air outlets to create an area of reduced pressure adjacent said air outlets to draw air from said outlets into said water passage means.

* * * * *